United States Patent [19]

Urwin

[11] Patent Number: 4,993,712

[45] Date of Patent: Feb. 19, 1991

[54] APPARATUS MOUNTED ON A TENNIS RACKET AND USED TO RETRIEVE A TENNIS BALL

[76] Inventor: Kenneth J. Urwin, 123 Potrero La., Star Rte., Santa Barbara, Calif. 93105

[21] Appl. No.: 426,856

[22] Filed: Oct. 26, 1989

[51] Int. Cl.[5] ..... A63B 49/00

[52] U.S. Cl. ..... 273/73 R; 273/DIG. 30

[58] Field of Search ..... 273/73 R, 73 F, 162 E, 273/DIG. 30

[56] References Cited

U.S. PATENT DOCUMENTS

| | | | |
|---|---|---|---|
| 4,114,881 | 9/1978 | Norton | 273/73 R |
| 4,210,327 | 6/1980 | Schubert | 273/73 R |

FOREIGN PATENT DOCUMENTS

| | | | |
|---|---|---|---|
| 2591497 | 6/1987 | France | 273/73 R |
| 2594037 | 8/1987 | France | 273/73 R |

*Primary Examiner*—Edward M. Coven

*Assistant Examiner*—William E. Stoll

*Attorney, Agent, or Firm*—Thomas I. Rozsa

[57] ABSTRACT

An apparatus which is attached to a tennis racket at one or more locations and which is configured to securely grasp and pick up a tennis ball, thereby permitting the user to use the tennis racket to pick up the tennis ball and eliminate the requirement for the user to bend down on numerous occasions. The apparatus has two key elements. The first is a removable ball gripping member which is configured in an arcuate shape conformed to the shape of the ball which is being retrieved such as a tennis ball and which further includes gripping means to grasp the surface of the ball. Second, the removable ball gripping member includes removable fastening means by which the removable ball gripping member can be attached to any desired location on the retrieving object such as a tennis racket and the tennis racket includes mating gripping apparatus at selected locations to hold the removable ball gripping apparatus.

14 Claims, 1 Drawing Sheet

APPARATUS MOUNTED ON A TENNIS RACKET AND USED TO RETRIEVE A TENNIS BALL

BACKGROUND OF THE INVENTION

1. Field of the Invention

The present invention relates to the field of ball retrieval apparatus and more particularly to the field of apparatus used to retrieve a tennis ball which has come to rest on the ground. Most commonly, when a tennis player is practicing shots by himself or when two players are playing a game, numerous tennis balls are used and come to rest on the ground after a point is played during the game, either within or outside the court. The present invention relates to the field of apparatus used to pick-up a tennis ball in a manner by which the player does not have to frequently bend down to retrieve the ball, thereby substantially reducing the wear and tear on the tennis player's back and significantly reducing fatigue.

2. Description of the Prior Art

In general, ball retrieving devices are known in the prior art. There are numerous devices used for retrieving golf balls and tennis balls which involve an elongated object having an open bottom to be fit over the ball and a handle and trigger mechanism, sometimes including a spring mechanism, by which the ball is scooped up into the elongated object and subsequently placed in a basket or other ball retaining receptacle.

The concept of placing the retrieving means on the butt end of the handle of a tennis racket has been invented and two types of embodiments which utilize this principle are disclosed in the following United States patents:

1. U.S. Pat. No. 4,114,881 issued to Norton on Sept. 19, 1978 for "Ball Retriever" ("Norton Patent").

2. U.S. Pat. No. 4,210,327 issued to Schubert on July 1, 1980 for "Racket-Mounted Tennis Ball Retriever" ("Schubert Patent").

The Norton Patent discloses a recess formed into the butt end of the handle of the tennis racket with the recess containing a clip member 32. As illustrated in FIG. 3 of the patent, the clip member is designed to spread out and grasp the fuzzy surface of the tennis ball. The ends 34 of clip member 32 have, a plurality of hook means which may be of a VELCRO ® type, which can grasp the surface of the tennis ball. While in theory the device should work well, in practice the device is not satisfactorily functional. The spreading clip 32 can only grasp a small portion of the surface of the tennis ball and in fact is prevented from grasping very much of the tennis ball by the arms 20 of the butt end of the handle of the tennis racket. Therefore, in practice the apparatus as illustrated in the Norton Patent does not work well.

The Schubert Patent also employs a member having hook like grasping means formed into a recess in the butt end of the tennis racket. While in theory this should work, in practice it does not work because the amount of grasping member formed in the recess of the butt end of the handle of the tennis racket is not sufficient to adequately grasp the ball. As with the Norton Patent, there is only one place where the apparatus provides for a means to attempt to grasp the tennis ball and that is at the butt end of the handle of the tennis racket. In Column 1, lines 17 through 25, the patent discloses a prior art device comprising an adhesive strip containing a multiplicity of hooks which are adhered to the rounded frame at the head of the racket. A flaw in this device is that the tennis ball must be secured under-foot to keep it from scooting away before the adhesive strip has a chance to grasp the ball. In addition, it appears that the strip which follows the contour of the head of the tennis racket has a curve diametrically opposite to the curve on the tennis ball, meaning that only one small area of the strip can come in contact with the tennis ball, making it very unlikely that the ball can be grasped securely enough to be picked up.

Therefore, there is a significant need for an improvement on the devices disclosed and discussed in the Norton and Schubert Patents by which the user is afford more than one location for grasping the tennis ball and the means to grasp the tennis ball more properly conforms to the arc of the tennis ball and provides more gripping surface area to assure that the ball can be retrieved.

SUMMARY OF THE PRESENT INVENTION

The present invention is an improved apparatus which is attached to a tennis racket at one or more locations and which is configured to securely grasp and pick up a tennis ball, thereby permitting the user to use the tennis racket to pick up the tennis ball and eliminate the requirement for the user to bend down on numerous occasions. This reduces the possibility of back injury and further reduces the fatigue, wear and tear on the user.

The present invention involves two key elements. The first is a removable ball gripping member which is configured in an arcuate shape conformed to the shape of the ball which is being retrieved such as a tennis ball and which further comprises gripping means to grasp the surface of the ball. Second, the removable ball gripping member comprises removable fastening means by which the removable ball gripping member can be attached to any desired location on the retrieving object such as a tennis racket and the tennis racket comprises mating gripping means at selected locations to hold the removable ball gripping means.

More particularly, it has been discovered, according to the present invention, that if there is used an arcuate shaped gripping piece which has an internal concave arc which is the same size as or slightly smaller than a tennis ball and comprising ball gripping means such as hook type VELCRO ® members on its interior arcuate surface, then the place can be securely attached, to a tennis ball because the hook type VELCRO ® fasteners grasp the fuzzy surface of the tennis ball and the arcuate shape conformed to the arc of the spherical body of the tennis ball enables a large portion of the gripping means of the arcuate shaped piece to come in contact with and attach to the tennis ball to thereby securely grip the tennis ball.

It has further been discovered that if the base portion of the arcuate shaped gripping member further comprises fastening means which can be grasped by a mating fastening means placed at any desired location on the retrieval object such as a tennis racket, then the arcuate shaped retrieval means can be removably affixed to any desired location of the tennis racket so that the user has a multiplicity of locations from which to select for positioning the retrieval means. Two such selected locations on the tennis racket can be the butt end of the handle of the tennis racket and the outer circumference of the frame of the head of the tennis racket. The attaching means can be mating VEL- CRO® fasteners. For example, the loop VELCRO® member can be attached to the butt end of the handle of the tennis racket and also attached to a portion of the frame, of the head of the tennis racket and a hook VELCRO® member can be attached to the base of the arcuate shaped gripping member. Of course, these could be reversed with the tennis racket having the hook VELCRO® member and the base of the arcuate shaped gripping member having the loop VELCRO® member.

It is therefore an object of the present invention to provide a means for gripping the fuzzy surface of a tennis ball so that it can be securely picked up and provide a multiplicity of locations on the tennis racket from which the user can choose to affix the gripping means.

It is a further object of the present invention to location of a tennis racket to enable the user to use the tennis racket as an extension object to bring the gripping means into contact with a tennis ball so that the ball can be picked up.

It is an additional object of the present invention to provide a gripping member which conforms to the arc and shape of the tennis ball and provides a gripping member of sufficient size so that a substantial portion of the surface of the tennis ball can be picked up and securely gripped.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can be represent applications of the principles of the invention. Various changes and modifications obvious to one skilled in the art to which the invention pertains are deemed to be within the spirit, scope and contemplation of the invention as further defined in the appended claims.

Figure 1:
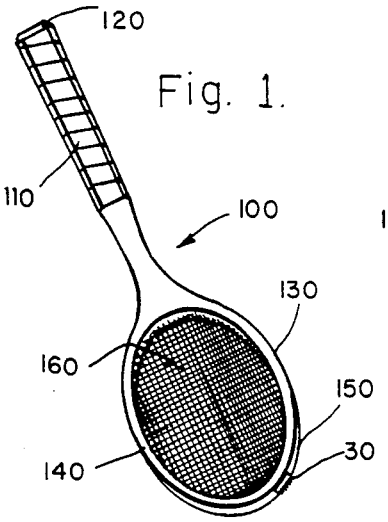
FIG. 1 is a perspective view of a tennis racket, illustrating a gripping means for the arcuate shaped gripping member attached to a location along the outer surface on the frame of the head of the tennis racket.

Referring particularly to FIG. 1, there is shown at 100 a conventional tennis racket having a handle 110 terminating in a butt end 120 and a head 130 including a frame 140 and strings 160. The frame 140 has an outer surface 150. Attached at a location on the surface 150 of frame 140 of head 130 is a gripping means 30. As illustrated in FIG. 1, the gripping means is located off to one side from the top of the frame 140. It will be appreciated that the gripping means 30 can be placed at any location along the outer surface 150 of frame 140 but it has been discovered that the location just offset from the top provides the most effective location for using the tennis racket 100 as an extension for the present invention.

Figure 2:
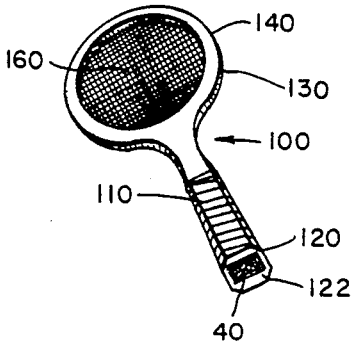
FIG. 2 is a perspective view of a tennis racket, illustrating a gripping means for the arcuate shaped gripping member attached to the tip of the butt end of the handle of the tennis racket.
Figure 4:
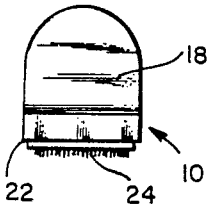
FIG. 4 is an end view of the arcuate shaped gripping member.

Referring to FIG. 2, there is shown another perspective view of a tennis racket 100 but looking from the butt end 120 of the handle 110. A gripping means 40 is affixed to the lower surface 122 of butt end 120.

In each case, the gripping means 30 and 40 are preferably VELCRO® type fasteners and preferably are loop VELCRO® fasteners. It will be appreciated that it is also possible for gripping means 30 and 40 to be hook VELCRO® fasteners. The gripping means 30 and 40 are permanently affixed to their respective locations on the tennis racket by any suitable adhesive that can bond the gripping means to the surface of the tennis racket to which it is attached.

Figure 3:
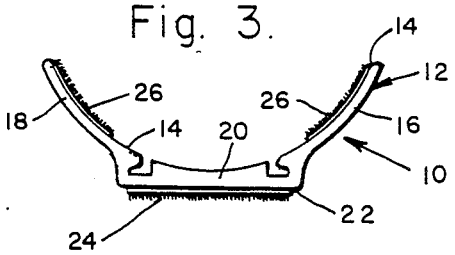
FIG. 3 is a side elevational view of the arcuate shaped gripping member.
Figure 5:
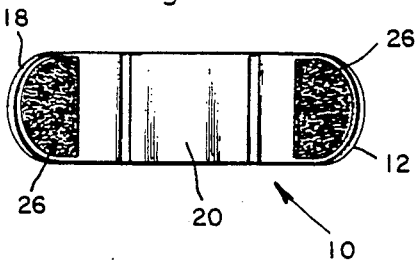
FIG. 5 is a top plan view of the arcuate shaped gripping member.

The key element of the present invention is the arcuate shaped gripping member 10 illustrated in FIGS. 3 and 5. The arcuate shaped gripping member 10 has a generally arcuate frame 12 having an interior surface 14. The shape of the arcuate frame 12 is configured to be identical to or slightly smaller than the arc on the spherical surface of a conventional tennis ball. The arcuate frame has two arcuate arms 16 and 18. Arm 16 extends into a generally straight base member 20 and arm 18 also extends into the generally straight base member 20. The interior surface 14 of arcuate frame 12 has affixed to it ball gripping means 26 which by way of example can be VELCRO® fasteners. The ball gripping means 26 is affixed at the location of arms 16 and 18. It is important that the VELCRO® fasteners for ball gripping means 26 be hook VELCRO® fasteners in order to be attached securely to the fuzzy surface of a tennis ball. Base 20 has an exterior surface 22 to which is attached gripping means 24. Gripping means 24 is matched to gripping means 30 and 40 on the tennis racket 100. Assuming gripping means 30 and 40 are loop VELCRO® fasteners, the gripping means 24 comprises hook VELCRO® fasteners to be removably joined thereto. If gripping means 30 and 40 have hook VELCRO® fasteners, then gripping means 24 comprises loop VELCRO® fasteners. Gripping means 24 can be attached to exterior surface 22 of base 20 by any suitable adhesive. Similarly, ball gripping means 26 can be affixed to the interior surface 14 of frame 12 by any suitable adhesive.

Figure 6:
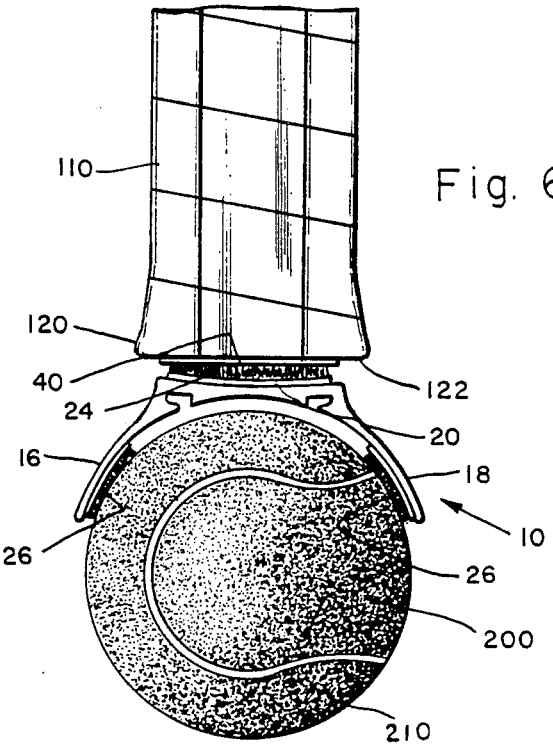
FIG. 6 is a side elevational view of a portion of the butt end of the handle of the tennis racket with the gripping means attached and gripping the arcuate shaped gripping member which in turn is gripping a tennis ball.

The present invention in use is illustrated in FIG. 6. The handle 110 of tennis racket 100 terminates in a butt end 120 having lower surface 122 to which is affixed gripping means 40 such as loop VELCRO® fasteners. The arcuate shaped gripping member 10 is removably affixed to the gripping means 40 by gripping means 24 which are hook VELCRO® fasteners. The arcuate shaped gripping member 10 is positioned over a tennis ball 200 such that the fuzzy surface 210 of the tennis ball 200 comes in contact with ball gripping means 26 and the tennis ball fits snugly within the interior arc of arcuate shaped gripping member 10 so that ball gripping means 26 which are preferably hook VELCRO® fasteners can securely be attached to a large section of the surface 210 of tennis ball 200. The user then holds the tennis racket 100 by the head 130 and pushes the handle 110 toward the tennis ball 200 until the arcuate shaped gripping member 10 has retained the tennis ball in the manner just described.

It will be appreciated that the arcuate shaped gripping member 10 can be removably affixed to the gripping means 30 located on the outer surface 150 of the frame 140 of the head 130 of the tennis racket 100 in an identical manner. In that case, the user holds the tennis racket 100 by the handle 110 and pushes the head 130 and its retained arcuate shaped gripping member 10 onto the tennis ball.

Through use of the present invention, the tennis ball can be easily and securely gripped. In addition, the user has a selection of where to place the gripping member for the best use by that individual user. It is also possible and within the spirit and scope of the present invention to have several arcuate shaped gripping members 10 simultaneously removably affixed at various locations along the surface 150 of frame 140 and the butt end 120 of the tennis racket.

The arcuate shaped gripping member can be made of any strong resilient material such as Delryn Plastic or Nylon.

In addition to the advantages already mentioned, the present invention is also much easier to manufacture than the cumbersome designs of the prior art where extensive fabrication in the butt end of the handle of the tennis racket was required.

The present invention can therefore be defined as an apparatus mounted on a tennis racket and used to retrieve a tennis ball, comprising: (a) an arcuate shaped gripping member further comprising, (i) a generally arcuate frame having a concave interior surface configured to be similar in shape to the arc on the spherical surface of a tennis ball, (ii) the arcuate frame including a central base member, a first arm extending from one side of the central base and a second arm extend from the opposite side of the central base, (iii) ball gripping means affixed to the concave interior surface at the locations of the first arm and the second arm, (iv) the central base having an exterior surface to which is attached racket gripping means; (b) means for gripping the racket gripping means of said central base attached to at least one area of the tennis racket; (c) said ball gripping means configured to grasp the fuzzy surface of a tennis ball when the arcuate shaped gripping member is pushed onto a tennis ball; and (d) said means for gripping the racket gripping means matched to removably grip the racket gripping means when the two are brought together; (e) whereby a user can removably place the arcuate shaped gripping member onto the tennis racket at the location of said means for gripping the racket gripping means and use the tennis racket as an extension to push the arcuate shaped gripping member onto a tennis ball where it will be gripped by said ball gripping means.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. An apparatus mounted on a tennis racket and used to retrieve a tennis ball having fibers on its surface, comprising:

a. an arcuate shaped gripping member further comprising,
   (i) a generally arcuate frame having a concave interior surface configured to be similar in shape to the arc on the spherical surface of a tennis ball,
   (ii) the arcuate frame including a central base member, a first arm extending from one side of the central base and a second arm extend from the opposite side of the central base,
   (iii) ball gripping means made of hook type VELCRO® fasteners affixed to the concave interior surface at the locations of the first arm and the second arm and extending generally perpendicular to the concave interior surface of the first arm and generally perpendicular to the concave interior surface of the second arm so as to also extend generally perpendicular to the surface of the tennis ball when the tennis ball is placed in the arcuate frame so that the hook type VELCRO® fasteners will firmly grasp with fibers on the surface of a tennis ball,
   (iv) the hook type VELCRO® fasteners on the concave interior surface of the first arm being oppositely disposed to the corresponding hook type VELCRO® fasteners on the concave interior surface of the second arm so as to provide a coordinated effect in securely gripping the fibers of the tennis ball;
   (v) the central base having an exterior surface to which is attached VELCRO® gripping means;

b. the tennis racket having a head including a frame member having an exterior surface to which is attached a first VELCRO® gripping means for removably retaining said arcuate shaped gripping member;

c. the tennis racket having a handle including a butt end having a lower surface to which is attached a second VELCRO® gripping means for removably retaining said arcuate shaped gripping member;

d. said hook type VELCRO® fasteners of the ball gripping means configured to grasp the fibers on a surface of a tennis ball when the arcuate shaped gripping member is pushed onto a tennis ball; and e. said first VELCRO® gripping means and said second VELCRO® gripping means each matched to the VELCRO® gripping means on the exterior surface of the central base of said arcuate shaped gripping member so as to removably grasp the VELCRO® gripping means on the exterior surface of the central base when the two VELCRO® gripping means are brought together;

f. whereby a user can removably place the arcuate shaped gripping member onto the tennis racket at the location of said first VELCRO® gripping means or said second VELCRO® gripping means and use the tennis racket as an extension to push the arcuate shaped gripping member onto a tennis ball where it will be gripped by said hook VELCRO® fasteners.

2. An apparatus mounted on a tennis racket and used to retrieve a tennis ball in accordance with claim 1 wherein said first VELCRO® gripping means is attached to one side of the top of the frame of the tennis racket.

3. An apparatus mounted on a tennis racket and used to retrieve a tennis ball in accordance with claim 1 wherein said first VELCRO® gripping means comprises loop VELCRO® fasteners, said second VELCRO® gripping means comprises loop VELCRO® fasteners, and said VELCRO® gripping means on the exterior surface of said base comprises hook VELCRO® fasteners.

4. An apparatus mounted on a tennis racket and used to retrieve a tennis ball in accordance with claim 1 wherein said first VELCRO® gripping means comprises hook VELCRO® fasteners, said second VELCRO® gripping means comprises hook VELCRO® fasteners, and said VELCRO® gripping means on the exterior surface of said base comprises loop VELCRO® fasteners.

5. An apparatus mounted on a tennis racket and used to retrieve a tennis ball in accordance with claim 1 wherein the arcuate frame of said arcuate shaped gripping member is made of Delryn plastic.

6. An apparatus mounted on a tennis racket and used to retrieve a tennis ball in accordance with claim 1 wherein the arcuate frame of said arcuate shaped gripping member is made of nylon.

7. An apparatus mounted on a tennis racket and used to retrieve a tennis ball having fibers on its surface, comprising:

a. an arcuate shaped gripping member further comprising,
   (i) a generally arcuate frame having a concave interior surface configured to be similar in shape to the arc on the spherical surface of a tennis ball,
   (ii) the arcuate frame including a central base member, a first arm extending from one side of the central base and a second arm extend from the opposite side of the central base,
   (iii) ball gripping means made of hook type VELCRO® fasteners affixed to the concave interior surface at the locations of the first arm and the second arm and extending generally perpendicular to the concave interior surface of the first arm and generally perpendicular to the concave interior surface of the second arm so as to also extend generally perpendicular to the surface of a tennis ball when a tennis ball is placed in the arcuate frame so that the hook type VELCRO® fasteners will firmly grasp with fibers on the surface of a tennis ball,
   (iv) the hook type VELCRO® fasteners on the concave interior surface of the first arm being oppositely disposed to the corresponding hook type VELCRO® fasteners on the concave interior surface of the second arm so as to provide a coordinated effect in securely gripping the fibers of a tennis ball;
   (v) the central base having an exterior surface to which is attached first means for gripping the racket;
b. second means for gripping the racket gripping means of said central base attached to at least one area of the tennis racket;
c. said hook type VELCRO® fasteners of the ball gripping means configured to grasp the fibers on a surface of a tennis ball when the arcuate shaped gripping member is pushed onto a tennis ball; and
d. said second means for gripping the racket matched to the VELCRO® gripping means on the exterior surface of the central base of said arcuate shaped gripping member so as to removably grasp the VELCRO® gripping means on the exterior surface of the central base when the two VELCRO® gripping means are brought together;
e. whereby a user can removably place the arcuate shaped gripping member onto the tennis racket at the location of said means for gripping the racket gripping means and use the tennis racket as an extension to push the arcuate shaped gripping member onto a tennis ball where it will be gripped by said hook VELCRO® fasteners.

8. An apparatus mounted on a tennis racket and used to retrieve a tennis ball in accordance with claim 7 wherein said means for gripping the racket gripping means of said central base is attached to the exterior surface of the frame of the head of the tennis racket.

9. An apparatus in accordance with claim 7 wherein said means for gripping the racket gripping means is attached to one side of the top of the head of the tennis racket.

10. An apparatus mounted on a tennis racket and used to retrieve a tennis ball in accordance with claim 7 wherein said means for gripping the racket gripping means of said central base is attached to the lower surface of the butt end of the handle of the tennis racket.

11. An apparatus mounted on a tennis racket and used to retrieve a tennis ball in accordance with claim 7 wherein said first racket gripping means comprises hook VELCRO® fasteners and said second means for gripping said first racket gripping means comprises loop VELCRO® fasteners.

12. An apparatus mounted on a tennis racket and used to retrieve a tennis ball in accordance with claim 7 wherein said first racket gripping means comprises loop VELCRO® fasteners and said second means for gripping said first racket gripping means comprises hook VELCRO® fasteners.

13. An apparatus mounted on a tennis racket and used to retrieve a tennis ball in accordance with claim 7 wherein the arcuate frame of said arcuate shaped gripping member is made of Delryn plastic.

14. An apparatus mounted on a tennis racket and used to retrieve a tennis ball in accordance with claim 7 wherein the arcuate frame of said arcuate shaped gripping member is made of nylon.

* * * * *